United States Patent [19]

Chang

[11] Patent Number: 4,763,608

[45] Date of Patent: Aug. 16, 1988

[54] PIG HOLDER

[76] Inventor: David Chang, No. 120, Ta She Rd., Chia Cheng Tsun, Ta She Hsiang, Kaohsiung Hsien, Taiwan

[21] Appl. No.: 30,512

[22] Filed: Mar. 27, 1987

[51] Int. Cl.[4] ..... A61D 3/00

[52] U.S. Cl. ..... 119/98

[58] Field of Search ..... 248/125, 223.4, 295.1, 248/224.1, 224.2; 17/1 A, 17, 44, 44.2; 119/96, 98, 103, 29

[56] References Cited

U.S. PATENT DOCUMENTS

| | | | |
|---|---|---|---|
| 3,744,457 | 7/1973 | Heine et al. | 119/103 |
| 3,766,890 | 10/1973 | Baker | 119/96 |
| 4,213,424 | 7/1980 | Hosch et al. | 119/98 |

FOREIGN PATENT DOCUMENTS

| | | | |
|---|---|---|---|
| 211283 | 12/1956 | Australia | 119/98 |
| 1267202 | 3/1969 | United Kingdom | 17/44 |

*Primary Examiner*—Robert P. Swiatek
*Assistant Examiner*—R. Thomas Price
*Attorney, Agent, or Firm*—Varndell Legal Group

[57] ABSTRACT

A pig holder which comprises a U-shaped support for holding pigs of different sizes together with a rubber band and buckles respectively located on each side of the U-shaped member. The U-shaped member extends above a base and is supported in a manner which permits free access to the body of the pig, allows adjusting the height of the U-shaped support and permits rotation of the U-shaped support about the base.

7 Claims, 5 Drawing Sheets

PIG HOLDER

BACKGROUND AND SUMMARY OF THE INVENTION

After farrowing, the newborn pigs must go through the following operations:

1. The eight needle teeth must be clipped, one on each side of the upper and lower jaws. This must be done soon after birth to reduce potential damage to the sow's udder. This must also be done skilfully without forcibly twisting and pulling the teeth. Otherwise, the gums and or tongue may be injured.

2. The tail must be removed up to about one-half inch from its base. This prevents tail biting, which can occur when the pigs become older. Tail biting will affect the conversion rate or even cause death.

3. The ears must be notched. In order to facilitate management of pigs and to improve the species, the ears of all pigs, commercial or breeder, are notched soon after birth for litter identification and follow-up management. It is important that the positions of the notches on four sides of the left and right ears must be correct. Otherwise, the pigs cannot be correctly identified.

4. Iron preparations, 2 CC, must be administered by the time the pigs are four days old.

In hog farm management, it is better to finish the above mentioned operations carefully at one time, so as to reduce the amount of stress on the pigs.

At present, these operations are usually performed on a hog farm by one person while another person assist in holding the pig. If no one assists in holding the pig, the operation may take more time and effort and can only be carried out by a skilled operator only. For example, when clipping the needle teeth, the operator or worker must carry the newborn pig in this arm, open the upper and lower jaws of the pig with the thumb and index finger of his left hand, hold its forelimbs with his other fingers, and clip its needle teeth with a pair of clippers in his right hand. Thereafter, the operator must invert the pig, hold its hindlimbs and the tail of the pig with his fingers, and remove the tail with the clippers.

A skilled operator may hold the pig by its jaws with his left hand, not in his arm, and let the pig hang in the air, while his thumb and index finger force open the pig's jaws. However, this is laborious and puts the pig under stress resulting in that the pig screams. After the needle teeth are clipped, the operator must then invert the pig and remove the tail, also in a laborious manner. In doing so, the worker must be skilful and careful. Otherwise, the needle teeth could be twisted or pulled, resulting in the gums being injured.

Ear notching is usually carried out by two persons because the positioning of notches must be accurate.

Some hog farms are unwilling to take the trouble of having a person cut notches while being careful to notch the ears accurately. Such notches are latter useless for litter identification.

Some hog farm owners train their workers, so that only one person cuts ear notches. In such a one man operation, a person holds the pig by the ear with one hand, while the pig screams and hangs in the air with its whole body supported by its tender ear. The person first holds the pig by its left ear, while cutting notches in the left ear. Then, the person holds the right ear and cuts notches in the right ear. This operation is laborious and the time taken is no less than that when two persons are used. Also, the scream of the pig under stress often makes the operator feel nervous.

In some other hog farms, the operator holds the pig by the ear with his left hand and by the body with his legs to reduce the stress on the pig of hanging in the air. However, this increases the danger of injuring the navel cord of the new born pig.

In view of the above mentioned disadvantages, the inventor developed the present invention to save time and labor. The experiments on the inventor's own hog farm have shown that a pig can be held on the holder of the present invention in two seconds, and there is no need for the operator to invert the pig and change hold of the pig's ear. The present invention not only saves labor, but also reduce the pig's stress. The present invention is so easy to operate that an unskilled person can perform the above mentioned operations.

A larger pig holder of the present invention can be used for administering drugs to the pigs in the nursery unit in order to prevent the danger of cough, because of a temporary blockage of the nasal passage. This temporary blockage often happens when administering drugs by a one-man operation.

A main object of this invention is to provide a pig holder comprising a U-shaped support with two rods and two tracks, all of which have screw holes and are fitted together in such a way that the height of the support can be adjusted as required when in operation.

Another object of this invention is to provide a pig holder in which the U-shaped support has a ring with a rubber band (or elastic band) on one side and front and rear buckles on the other side. This enables holding of newborn pigs of different sizes.

Still another object of this invention is to provide a pig holder having a cross bar with curved projections on the bottom side and a stand with corresponding notches on the top, so that the pig on the support can be turned about, as required in operation. This avoids abnormal turning and ensures safety of the pig, while providing convenience of work.

Still another object of this invention is to provide a pig holder which comprises a U-shaped support having a ring, a rubber band or elastic band, and a front buckle and rear buckle, two support rods extending from the U-shaped support, two sets of stays, and a II base frame which are welded together to form a simple holder.

DETAILED DESCRIPTION OF THE PREFERRED EMBODIMENT

Figure 1:
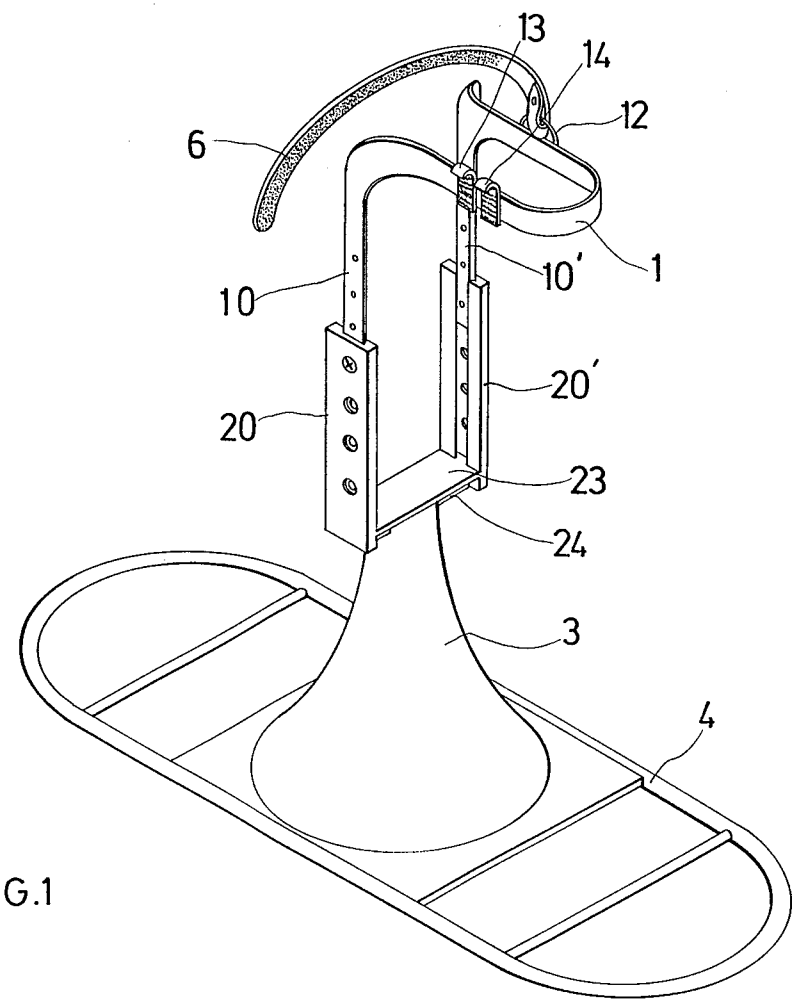
FIG. 1 is a vertical view of the pig holder of this invention.
Figure 2:
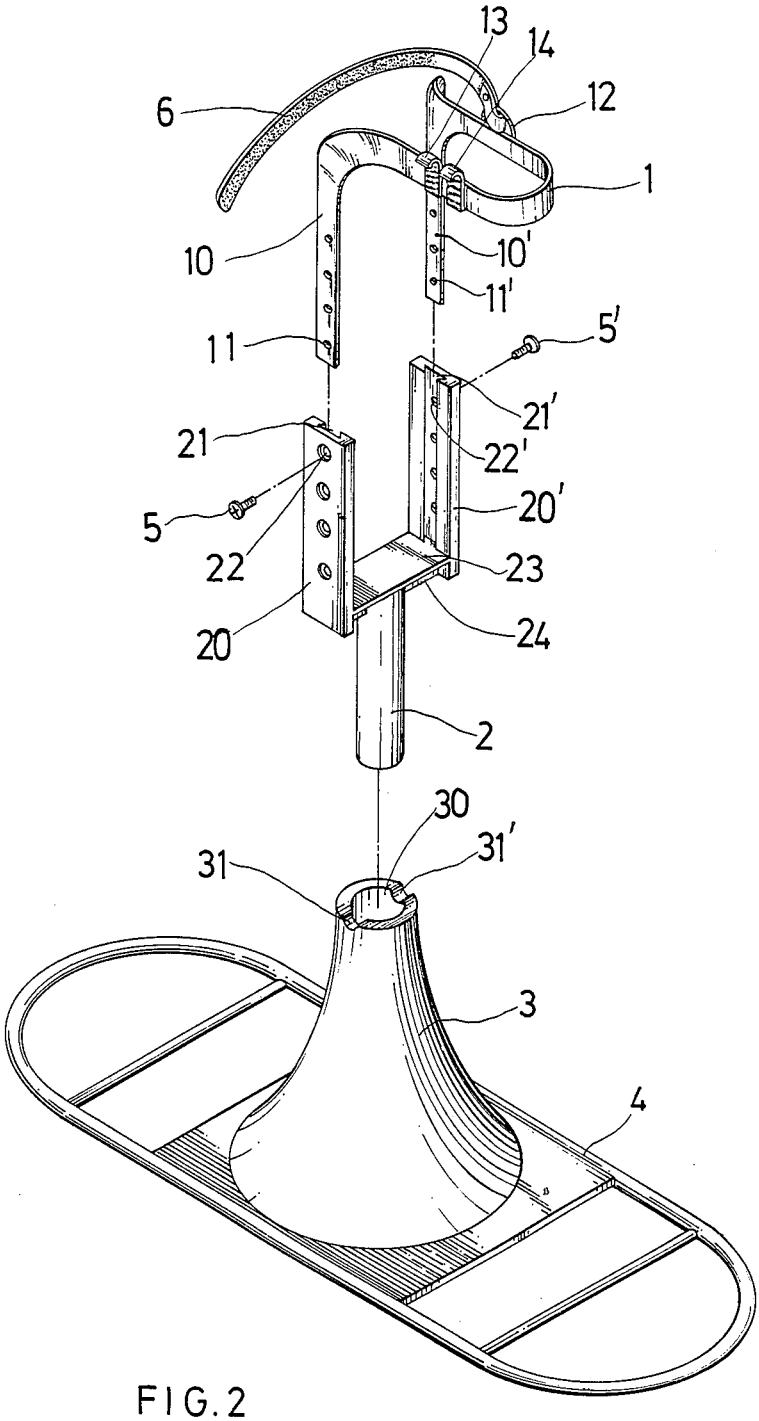
FIG. 2 is an exploded view of the holder.

As shown in FIG. 1, the pig holder of this invention comprises a U-shaped support 1, two rods 10, 10' extending downward from the U-shaped support 1, a cross bar 23, two side pieces 20, 20' extending upward from the cross bar 23, a column 2 extending downward from the bottom side of the cross bar 23 (as shown in FIG. 2), a stand 3 and a base frame 4.

As shown in FIG. 2, the U-shaped support 1 has a ring 12 on one side, a rubber band 6 fastened to the ring 12, and a front buckle 14 and rear buckle 13 on the other side. The rods 10, 10' of the U-shaped support 1 are slidably fitted in the tracks 21, 21' of the side pieces 20, 20' extending upward from the cross bar 23. A plurality of corresponding screw holes 11, 11', 22, 22' are provided in the rods 10, 10' and side pieces 20, 20', so that the rods 10, 10' and side pieces 20, 20' can be fixed by means of screws 5, 5' and the height of the U-shaped support 1 can be adjusted by changing the screw holes 11, 11', 22, 22'. The cross bar 23 has a column 2 extending downward from the middle of the bottom side and fitted in the central hole 30 of the stand 3. The cross bar 23 also has curved projections 24 on the bottom side to be fitted in the corresponding notches 31, 31' in the top rim of the stand 3. The stand 3 has a base frame 4 on the bottom to increase its firmness.

Figure 3:
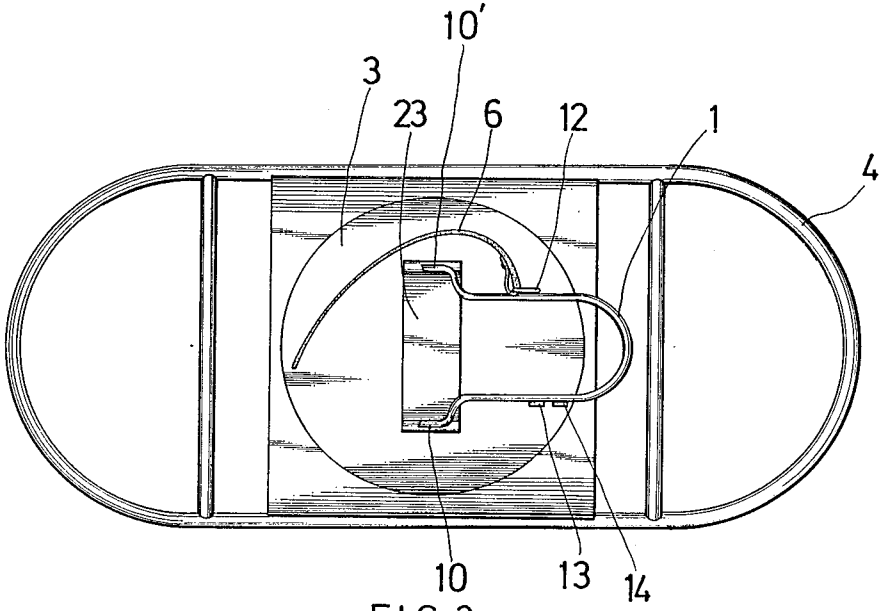
FIG. 3 is a top view of the holder.

As shown in FIG. 3, the rods 10, 10' of the U-shaped support 1 have outward bends 15, 15' designed to prevent the pig from hitting the frame and being injured after it is held on the holder.

Figure 4:
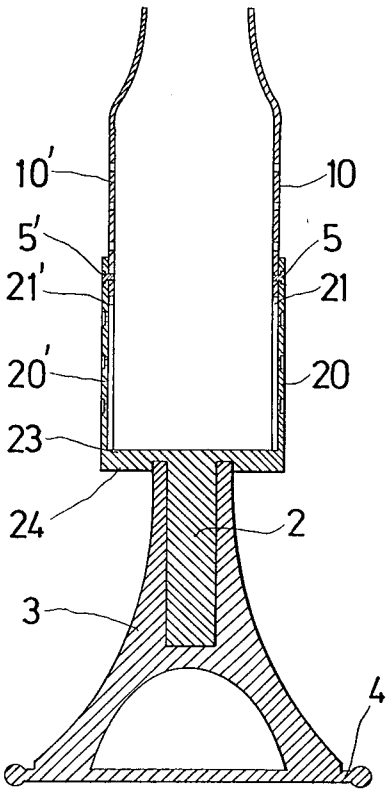
FIG. 4 is a longitudinal section of the holder.

As shown in FIG. 4, the curved projections 24 on the bottom side of the cross bar 23 are movably fitted in the notches 31, 31' in the top rim of the stand 3 so that the pig on the support 1 can be turned about as required in operation.

Figure 5:
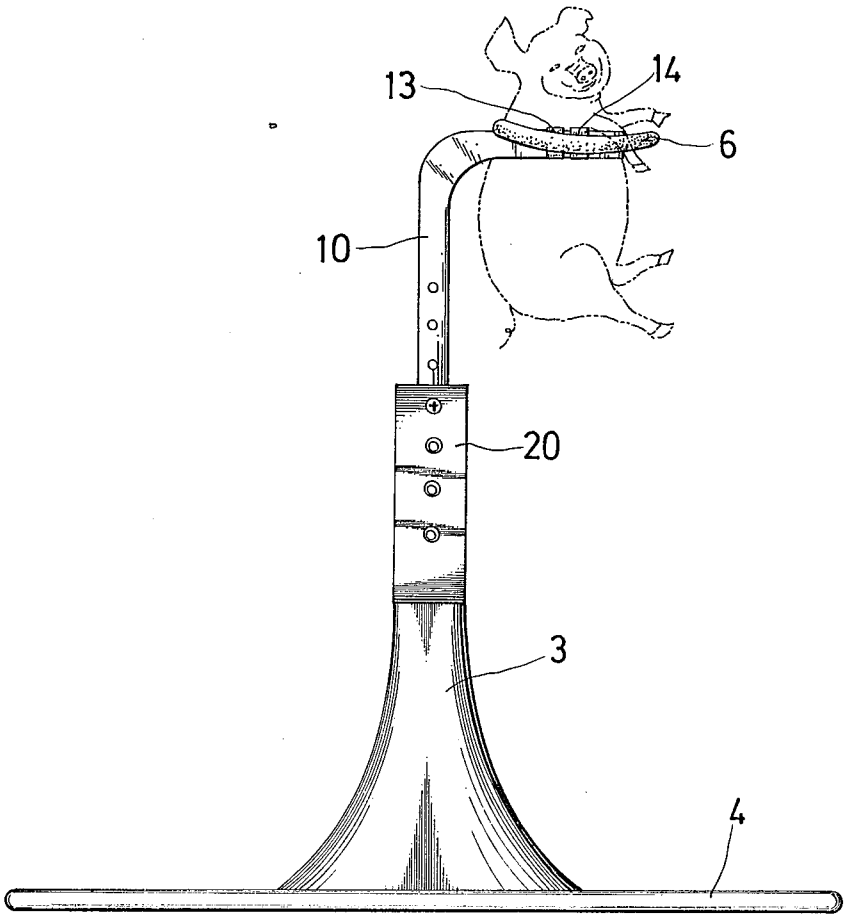
FIG. 5 is a side view of the holder with a pig being held.

As shown in FIG. 5, the front buckle 14 and the rear buckle 13 are fixed to the side of the U-shaped support 1 for holding pigs of different sizes. A large pig is held by putting the rubber band 6 on both the front and rear buckles 14, 13 and a smaller pig is held by putting the rubber band 6 on the front buckle 14 only.

Figure 6:
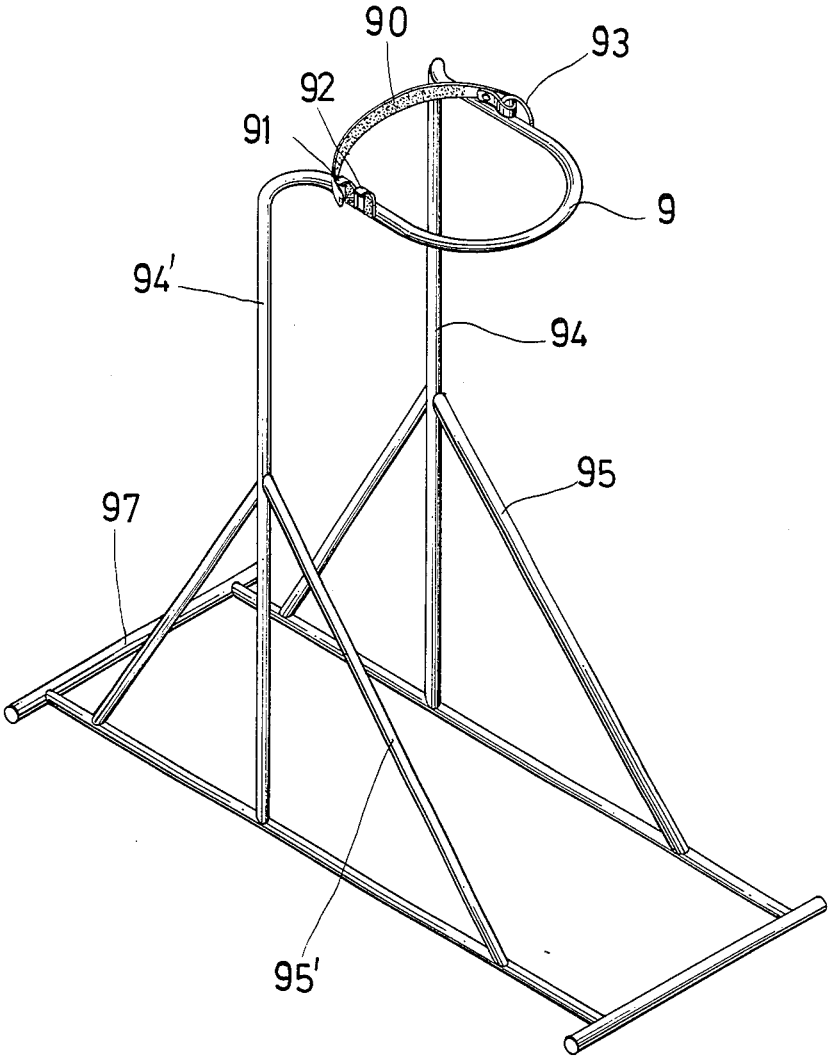
FIG. 6 is a vertical view of another preferred embodiment of this invention.

FIG. 6 shows another embodiment of the pig holder of this invention. This simpler pig holder comprises a U-shaped support 9, two rods 94, 94', two sets of stays 95, 95' and a II-shaped base frame 97. The U-shaped support has a ring 93 on one side and a rubber band (or elastic band) 90 fastened to the ring 93, and a front buckle 92 and rear buckle 91 on the other side. The support rods 94, 94' extending downward from the U-shaped support 9 and welded to the rear part of the II-shaped base frame 97, so as to balance the pig at the center of gravity of the holder. The two sets of stays 95, 95' are provided to enhance the firmness of the holder.

I claim:

1. A pig holder which comprises an upper, middle and lower sections, the upper section having a U-shaped support for holding a pig, the U-shaped support having its legs extending in a forward direction, only two support rods each extending downwardly from a forwardmost portion of each leg of the U-shaped support, the middle section having a cross bar, a column located at a central portion of the cross bar and extending downwardly, and two side bars respectively located at ends of the cross bar and extending in an upward direction, each side bar having a track for receiving the support rods of the upper section, the support rods have screw holes and the side bars having corresponding screw holes, the screw holes and corresponding screw holes cooperating with screw means to fasten the support rods within the side bars at different heights along the side bars, the lower section having a base frame for firmly placing the pig holder on a flat surface, a stand located at a central portion of the base frame and extending upward, the stand having a hole at an uppermost portion thereof for rotatably receiving the column of the middle section.

2. The pig holder as set forth in claim 1, further comprising holding means for grasping a pig in two seconds and for holding pigs of different sizes, said means including an elastic band fastened to one side of the U-shaped support, front and rear buckles located at an opposite side of the U-shaped support, the elastic band and each of the front and rear buckles cooperating to quickly hold and to quickly release a pig from the U-shaped holder.

3. The pig holder as set forth in claim 2, wherein the elastic band is a rubber band.

4. The pig holder as set forth in claim 1, wherein the cross bar has a curved projection on the bottom thereof and the uppermost portion of the stand has corresponding notches therein, the curved projection fitting in the corresponding notches and permitting rotatable movement of the middle section about the lower section.

5. The pig holder as set forth in claim 1, wherein the base frame has a planar surface for placing it on a flat surface and the U-shaped support is arranged parallel thereto, and wherein the upper, middle and lower sections are arranged so that a substantially open area is provided between the U-shaped support and the base frame for permitting easy access to all parts of a pig when held in the holder.

6. The pig holder as set forth in claim 1, wherein the lower section includes means for adding stability in cooperation with a part of a human body.

7. The pig holder as set forth in claim 6, wherein the means for adding stability includes a base frame said being shaped to permit a human foot to be flatly placed thereon.

* * * * *